US005577994A

United States Patent [19]

Celik

[11] Patent Number: 5,577,994

[45] Date of Patent: Nov. 26, 1996

[54] VACUUM MASSAGE APPLIANCE

[76] Inventor: Ursula Celik, Florenzer Str. 60, D-5000 Köln 71, Germany

[21] Appl. No.: 133,001

[22] PCT Filed: May 11, 1992

[86] PCT No.: PCT/EP92/01029

§ 371 Date: Oct. 5, 1993

§ 102(e) Date: Oct. 5, 1993

[87] PCT Pub. No.: WO92/20315

PCT Pub. Date: Nov. 26, 1992

[30] Foreign Application Priority Data

| | | | |
|---|---|---|---|
| May 21, 1991 | [DE] | Germany | 41 16 466 |
| Jun. 28, 1991 | [DE] | Germany | 41 21 416.1 |
| Sep. 30, 1991 | [DE] | Germany | 41 32 464.1 |
| Feb. 15, 1992 | [DE] | Germany | 42 04 547.9 |

[51] Int. Cl.[6] ..... A61H 9/00

[52] U.S. Cl. ..... 601/6; 601/11

[58] Field of Search ..... 601/6, 7, 8, 11–14, 601/9, 10, 119, 123, 131, 902

[56] References Cited

U.S. PATENT DOCUMENTS

| | | | |
|---|---|---|---|
| 916,098 | 3/1909 | Bramson | 601/7 |
| 1,177,566 | 3/1916 | Bick | 601/8 |
| 1,211,576 | 1/1917 | Hansen | 601/8 |
| 2,031,957 | 2/1936 | Karlstrom | 601/6 |
| 2,063,084 | 12/1936 | Farnon | 601/12 |
| 2,189,116 | 2/1940 | Niemiec | 601/6 |
| 2,266,931 | 12/1941 | Wheeler | 601/6 |
| 2,449,805 | 9/1948 | Develay | 601/8 |

FOREIGN PATENT DOCUMENTS

| | | | |
|---|---|---|---|
| 9115181 | 10/1991 | WIPO | 601/6 |

*Primary Examiner*—Robert A. Hafer
*Assistant Examiner*—David J. Kenealy
*Attorney, Agent, or Firm*—Herbert Dubno

[57] ABSTRACT

A massage appliance has a container which is moved in contact with the body of the massaged person and a handle connected with the container by a fork and pivot bearing arrangement such that the container can pivot about one axis with a swinging movement and rotate about another axis. A torsion spring restores the position of the container relative to the handle and a suction pipe is connected to the container so that suction can be applied concurrently with massage.

2 Claims, 2 Drawing Sheets

VACUUM MASSAGE APPLIANCE

CROSS REFERENCE TO RELATED APPLICATIONS

This application is a national phase of PCT/EP92/01029 filed 11 May 1992 and based upon German national applications P41 16 460.0 of 21 May 1991, P 41 21 416.1 of 28 Jun. 1991, P41 32 464.1 of 30 Sep. 1991 and P42 04 547.7 of 15 Feb. 1992 under the International Convention.

FIELD OF THE INVENTION

The present invention relates to a massage appliance which has a massage container and a suction pump and is provided with a handle.

BACKGROUND OF THE INVENTION

In most known massage applications which are provided with a handle, the handle is rigidly connected to the massage appliance. These massage appliances require an especially careful handling, in order to insure that the massage container stays in touch at all times and over its entire contact surface with the body of the patent. A suitable use of these massage appliances during self-treatment by the patient is therefore fraught with difficulties.

A massage appliance wherein the massage container is swingably connected to the handle is also known (FR-A-638 309). In this case only a very limited adjustment of the contact surface of the massage container to the body of the patient is possible, since the massage container performs motions only about a single axis.

There are also known massage appliances wherein the massage container is designed as a hollow body rotatably mounted on the handle, which during the massage rolls off the patient's body (DE-C-523 208 and DE-C-427 822). However, the rotatability of the massage container does not allow an adjustment of the contact surface of the massage appliance to the body of the patient.

OBJECT OF THE INVENTION

It is the object of the invention to provide an improved massage appliance which can ensure a perfect adjustment of the contact surface of the massage container to the body of the patient so that even during self-treatment by the patient no difficulties arise.

SUMMARY OF THE INVENTION

The object is achieved in an appliance wherein the massage container is rotatably and swingably connected with the handle. The massage appliance of the invention allows the massage container to move about several axes, so that independently of the hand guiding the massage appliance, the massage container remains at all times in contact with the body of the patient as long as a slight pressure is exerted on the body with the massage container.

In a development of the invention a rod is fastened to the massage container, which is rotatably supported in the handle and has a fork-like projection at its end facing the massage container, whereby the two ends of the fork-like projection engage in the swing bearing provided on the massage container, so that the massage container can swing with respect to the rod. The inner space of the massage container is in contact with the suction pump via a hose. The suction pump can consist of a manually actuatable rubber balloon. But the suction pump can also be a piston pump, an electro-vacuum pump or the like. Since the hose forms an elastic connection between the suction pump and the massage container, the movements of the massage container with respect to the handle are not impeded by the hose. The hose can constitute the only connection between the suction pump and the massage container.

In order to avoid generation of torque during the rotation and swinging motions of the massage container, according to a further feature of the invention the rotation axis of the rod and the swing axis of the massage container are both located within the same plane.

In a preferred embodiment of the invention, the rod is connected with the handle with a torsion spring, so that the rod is always returned to its basic position. The function of the torsion spring can also be taken over by the hose.

In another embodiment of the invention the upper part of the massage container is spherical and the handle is provided at is end facing the massage container with a ring or a hood with a capshaped inner wall which encloses the spherical part of the massage container.

Another embodiment of the massage appliance of the invention consists in that the handle is designed like a bell surrounding the massage container, which is rotatably and/or swingably connected with the massage container. Advantageously the massage container is cardanically connected with the ball (i.e. connected thereto by a universal joint). Thereby an especially good adjustment of the massage container to the body parts to be treated is insured.

In a further embodiment of the invention between the massage container and the bell a ring is provided, which has two inner pivot bearings and two outer pivot bearings, whereby the inner pivot bearings are connected with the massage container and the outer pivot bearings are connected with the bell.

In a further development of the invention the suction pump is rigidly connected with the bell. The suction pump can thereby be arranged outside or inside the bell.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
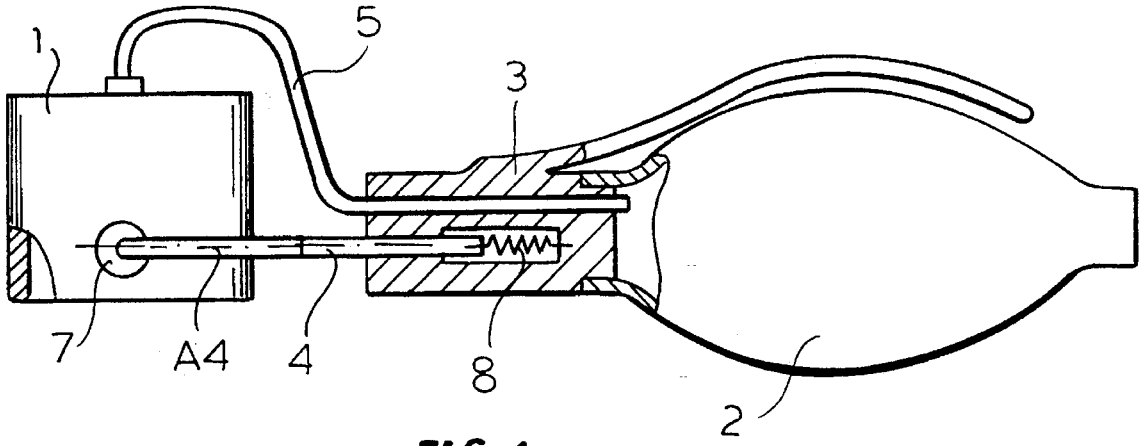
FIG. 1 is a side view of a massage appliance, partly broken away.
Figure 2:
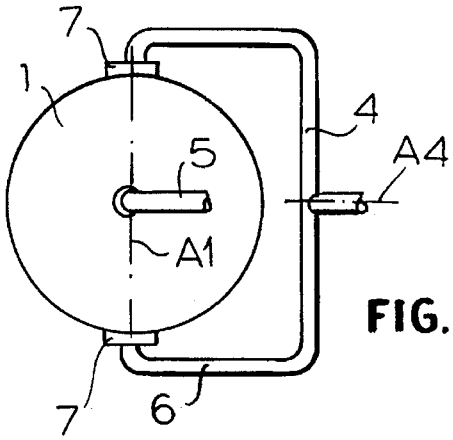
FIG. 2 is a top view of the massage container of the massage appliance shown in FIG. 1.

The massage appliance shown in FIGS. 1 and 2 has a massage container 1 and a suction pump 2, with a handle 3 arranged therebetween. The massage container 1 and the handle 3 are connected to each other via a rod 4, while the massage container 1 and the suction pump 2 are connected to each other via a hose 5. In the illustrated embodiment the hose 5 passes through the handle 3. The rod 4 which is supported in the handle 3 so that it can rotate about an axis of rotation A4, has on its end facing the massage container 1 a fork-like projection 6, whose both ends engage in the swing bearing 7 provided on the massage container 1, so that the massage container 1 can move about a swing axis A1. The rear end of rod 4 is connected with the handle 3 through a torsion spring 8.

Figure 3:
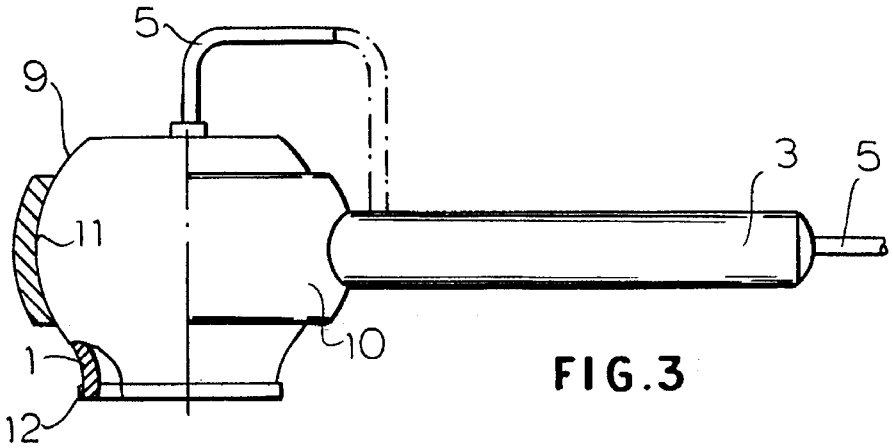
FIG. 3 is a side view of a second massage appliance, partly broken away.

In the massage appliance shown in FIG. 3 the upper part of the massage container 1 is spherical, while the handle 3 is provided at its end facing the massage container 1 with a ring 10 whose capshaped inner wall 11 surrounds the spherical part 9 of the massage container 1. At its rim which is in contact with the body of the patient, the massage container 1 can be coated with a layer 12 of a self-lubricating material. The hose 5 leading to the massage container 1 which in this case—as indicated by dash-dot lines—can also be passed through the handle 3, is connected to any kind of pump. The hose 5 can be the only connection between the massage container 1 and the suction pump.

Figure 4:
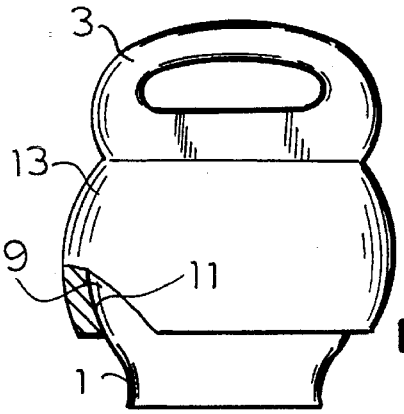
FIG. 4 is a side view of a third massage appliance also broken away.

In FIG. 4 a massage appliance is shown wherein the spherical part 9 of the massage container 1 is surrounded by a hood 13 with a capshaped inner wall 11. On the upper side of the hood 13 a handle 3 is provided.

Figure 5:
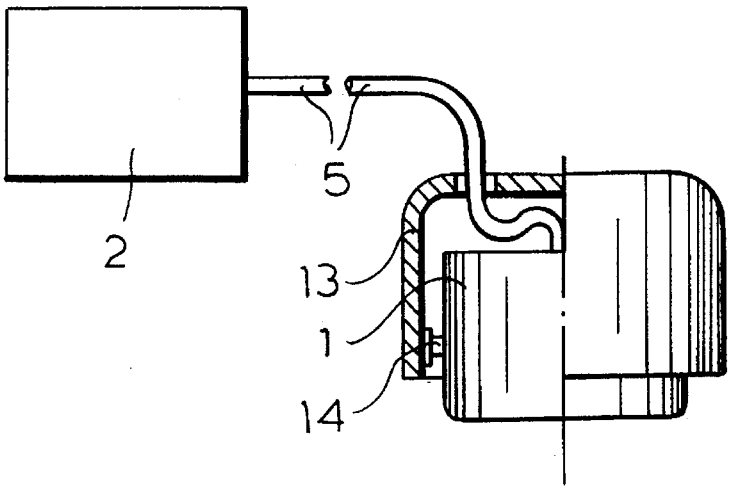
FIG. 5 is a side view of another massage appliance in half section.

The massage appliance shown in FIG. 5 has a massage container 1 which is connected via a hose 5 with a suction pump 2 and is surrounded by a bell 13. The bell 13 is connected with the massage container 1 through two pivot bearings 14 diametrically opposed to each other.

Figure 6:
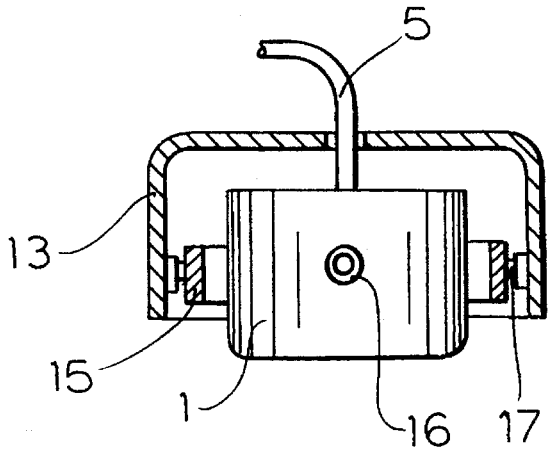
FIG. 6 is a longitudinal section through another massage appliance.
Figure 7:
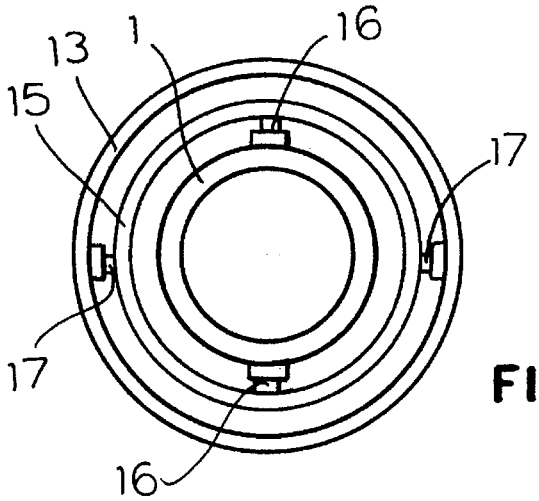
FIG. 7 is a bottom view of the massage appliance shown in FIG. 6.

In the massage container shown in FIGS. 6 and 7 the massage container 1 is cardanically connected (i.e. connected via a universal joint) with the surrounding bell 13. For this purpose serves a ring 15 which is connected with the massage container 1 through two diametrically opposite inner pivot bearings 16 and with the bell 13 through two diametrically opposite outer pivot bearings 17. Via a hose 5 the massage container 1 is connected with a suction pump—not shown in the drawing.

I claim:

1. A massage appliance, comprising;

a massage container configured and constructed to be moved in contact with body portions of a person to be massaged;

an elongated handle carrying said massage container;

means for connecting a suction pump to said massage container;

means for articulating by connecting said massage container to said handle for movement of said container relative to said handle about two different axes, including a rotational movement about one of said axes add a swinging movement about the other of said axes, said means for articulatingly connecting said massage container to said handle including:

a rod rotatably supported in said handle and rotatable relative to said handle about said one of said axes, a fork formed on an end of said rod turned away from said handle, pivot bearings between said fork and said container for swinging movement of said container about said other axis relative to said fork, said fork straddling said container, said means for connecting said suction pump to said massage container including a flexible hose connected to said massage container, said axes lying in the same plane, and a torsion spring between said rod and said handle for restoring said rod to an initial position upon rotation of said rod relative to said handle from said initial position.

2. A massage appliance, comprising:

a massage container configured and constructed to be moved in contact with body portions of a person to be massaged;

a handle carrying said massage container;

means for connecting a suction pump to said massage container;

means for articulatingly connecting said massage container to said handle for movement of said container relative to said handle about two different axes, including a rotational movement about one of said axes and a swinging movement about the other of said axes, said means for articulatingly connecting said massage container to said handle including:

a bell formed on said handle, a ring received in said bell, a pair of inner pivot bearings connecting said massage container to said ring for movement about one of said axes, and another pair of bearings between said ring and said bell connecting said ring to said bell for rotation about the other of said axes; and a suction pump rigidly connected with said bell.

* * * * *